US008674920B2

(12) United States Patent
Yang et al.

(10) Patent No.: US 8,674,920 B2
(45) Date of Patent: Mar. 18, 2014

(54) LIQUID CRYSTAL DISPLAY AND METHOD FOR DRIVING THE SAME

(75) Inventors: Chih-Hsiang Yang, Tao-Yuan Hsien (TW); Chih-Sung Wang, Hsin-Chu Hsien (TW); Yao Jen Hsieh, Ping-Tung Hsien (TW); Huan Hsin Li, Miao-Li Hsien (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 799 days.

(21) Appl. No.: 10/905,430

(22) Filed: Jan. 4, 2005

(65) Prior Publication Data

US 2006/0028415 A1 Feb. 9, 2006

(30) Foreign Application Priority Data

Aug. 3, 2004 (TW) ..... 93123274 A

(51) Int. Cl.
*G09G 3/36* (2006.01)
*G09G 5/10* (2006.01)

(52) U.S. Cl.
USPC ..... 345/94; 345/690

(58) Field of Classification Search
USPC ..... 345/690, 49, 87–100, 204, 103
See application file for complete search history.

(56) References Cited

U.S. PATENT DOCUMENTS 6,297,816 B1 * 10/2001 Nishitani et al. ..... 345/213
7,133,015 B1 * 11/2006 Yoshida et al. ..... 345/103
2002/0044115 A1 4/2002 Jinda et al.
2002/0067332 A1 6/2002 Hirakata et al.
2002/0109654 A1 * 8/2002 Kwon ..... 345/87
2003/0001845 A1 1/2003 Willis
2003/0048246 A1 * 3/2003 Ham ..... 345/87
2003/0169247 A1 9/2003 Kawabe et al.
2003/0227428 A1 12/2003 Nose
2004/0001054 A1 * 1/2004 Nitta et al. ..... 345/204
2004/0183792 A1 * 9/2004 Takada et al. ..... 345/204

FOREIGN PATENT DOCUMENTS

JP S6486197 A 3/1989
JP H0750389 B2 5/1995
JP H08221039 A 8/1996
JP 2000293141 A 10/2000
JP 2001195042 A 7/2001
JP 2002-41002 2/2002
JP 2003-22053 1/2003
JP 200461552 A 2/2004

OTHER PUBLICATIONS

"RSDS tm Specification, Revision 0.95", p. 1-8 May 2001, National Semiconductor Corp.
T.Nose et al.,"A Black Stripe Driving Scheme for Displaying Motion Pictures on LCDs.",SID 01 Digest, p. 994-997, ISSN/0001-0966X.

* cited by examiner

*Primary Examiner* — Kevin M Nguyen
(74) *Attorney, Agent, or Firm* — Winston Hsu; Scott Margo

(57) ABSTRACT

A method for driving a liquid crystal display (LCD) includes receiving image data of each display unit of the LCD in every display period to determine gray levels of the display units, controlling a gate driver of the LCD to scan each of the display units at least twice every display period, controlling a source driver of the LCD to generate a switch signal, controlling the source driver to determine the gray levels of one row of the display units when the switch signal is at a first voltage level, and controlling the source driver to drive one row of the display units to a predetermined gray level status when the switch signal is at a second voltage level.

3 Claims, 6 Drawing Sheets

LIQUID CRYSTAL DISPLAY AND METHOD FOR DRIVING THE SAME

BACKGROUND OF INVENTION

1. Field of the Invention

The invention relates to a liquid crystal display and method for driving the same, and more particularly, to inserting at least a black frame in a display period.

2. Description of the Prior Art

A liquid crystal display (LCD) has advantages of lightness, low power consumption, less radiation and applied to various portable electronic products such as notebook computers and personal digital assistants (PDAs). In addition, LCD monitors and LCD televisions are gaining popularity as a substitute for traditional cathode ray tube (CRT) monitors and televisions. However, due to their physical limitations, the liquid crystal molecules need to be constantly twisted and rearranged while an image data is changed, which often causes a delay phenomenon. Consequently, the delay phenomenon becomes even worse when a liquid crystal display is showing moving pictures.

In order to resolve common remaining pictures while the LCD is showing moving pictures, the related art often utilizes a method by inserting a black frame. Nevertheless, the efficacy is not obvious while the black frame is processed as other image data.

SUMMARY OF INVENTION

It is therefore an objective of the present invention to provide a liquid crystal display and method for driving the same for solving the problems stated previously.

The liquid crystal display includes a liquid crystal panel that further comprises a plurality of display units lined up in a matrix. The matrix includes a plurality of rows and columns, and each row of the display units is connected to a corresponding scan line, whereas each column of the display units is connected to a corresponding data line. The liquid crystal display also includes a source driver electrically connecting to the display units via the data lines, and a gate driver electrically connecting to the display units via the scan lines.

According to the present invention, the liquid crystal display further comprising: a first means for receiving image data in one of a plurality of display periods; a second means for scanning one of a plurality of display unit at least twice every display period; and a third means for generating a data switch signal and driving one row of the display units according to the data switch signal.

In addition, a method for driving a liquid crystal display (LCD) is disclosed, wherein the LCD comprising a plurality of display units defined into a plurality of rows and a plurality of columns. The method comprising: receiving image data of each display unit in each of a plurality of display periods; determining a gray level status of one row of the display units; scanning each of the display units at least twice every display period; generating a data switch signal; and driving one row of the display units according to the data switch signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
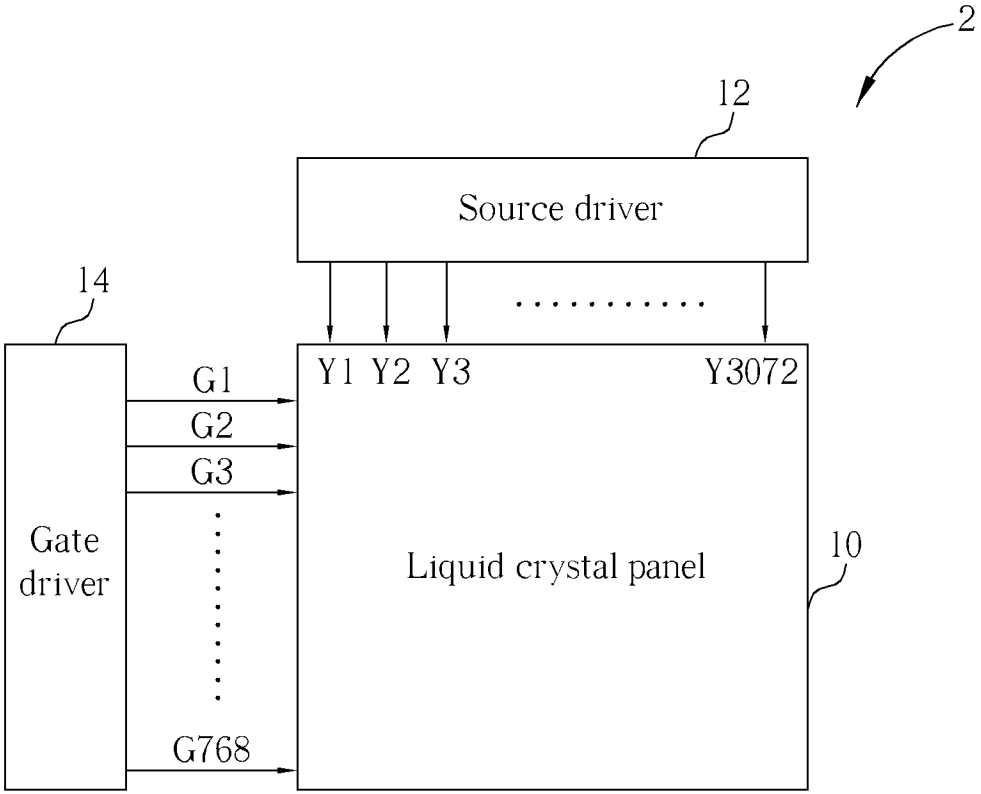
FIG. 1 is a schematic diagram showing the liquid crystal display of the present invention.
Figure 2:
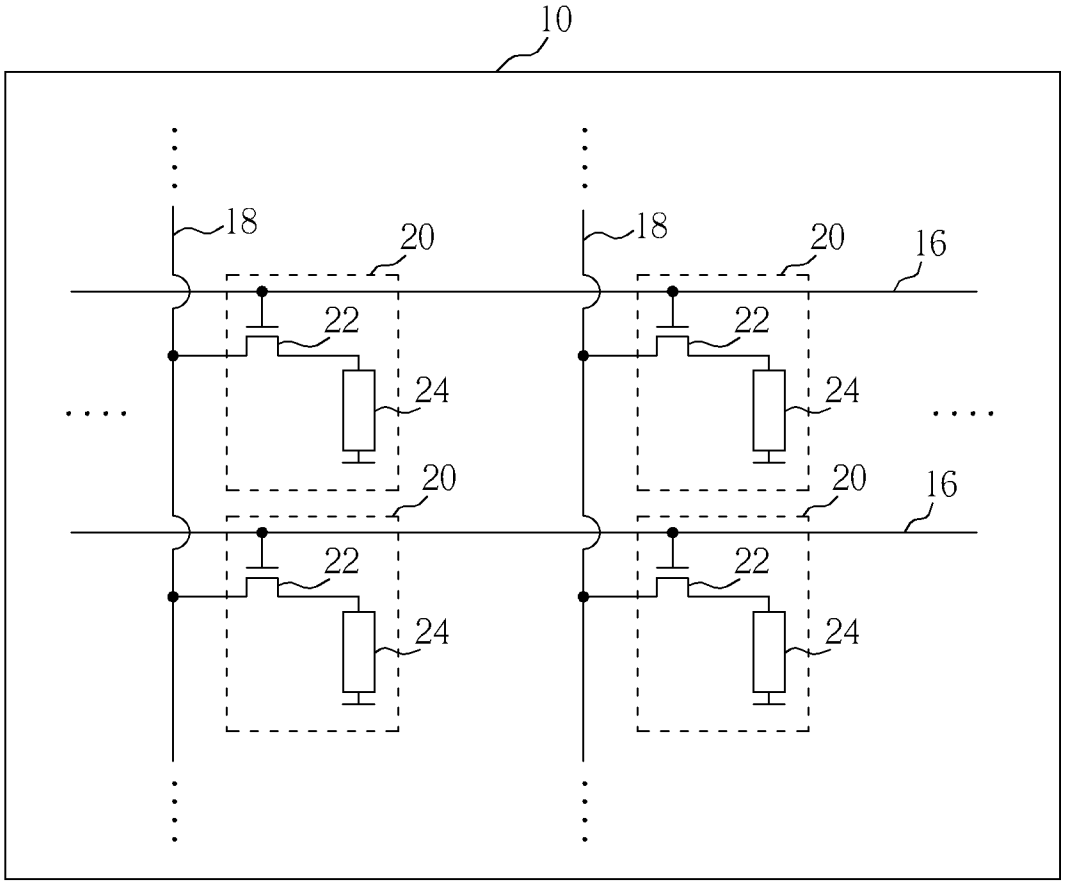
FIG. 2 is an electrical circuit diagram showing the liquid crystal display of FIG. 1.

Please refer to FIG. 1 and FIG. 2. FIG. 1 is a schematic diagram showing the liquid crystal display 2 of the present invention and FIG. 2 is an electrical circuit diagram showing the liquid crystal display of FIG. 1. The liquid crystal display 2 includes a liquid crystal panel 10, a source driver 12, and a gate driver 14. The source driver 12 and the gate driver 14 are electrically connected to the liquid crystal display 2 for controlling the liquid crystal panel 10. The liquid crystal panel 10 includes a plurality of display units 20 lined up in a matrix and the display units 20 further define additional display units including red display units, blue display units and green display units. Each of the display units 20 also includes a switch device 22 and a pixel electrode 24, and each column of the display units 20 is connected to a corresponding data line 18 and each row of the display units 20 is connected to a corresponding scan line 16. In essence, all of the data lines 18 are connected to the source driver 12 and all of the scan lines 16 are connected to the gate driver 14. Via the data line 18, the source driver 12 is able to be controlled to determine the gray level of the pixel electrode of each display unit 20 whereas the gate driver 14 is able to turn the switch device 22 of each display unit 20 on and off via the scan line 16.

As an example, the resolution of the liquid crystal panel 10 is 1024×768 pixels and each pixel further includes three different color display units 20 of red, blue, and green. In other words, the display units 20 of the liquid crystal display 10 is lined up in a total number of 2072 columns×768 rows. Essentially, the gate driver 14 will apply scanning voltages of G1-G768 from top to bottom to each scan line 16 for turning on the switch devices 22 of the display units. After the last row of the display units 20 is scanned, the gate driver 14 will restart the scanning process from the top row of the display units 20. When the switch device 22 of the display unit 20 is turned on, the source driver 12 will convert the received image data to a corresponding data line voltage Y1-Y3072 and apply the data line voltage Y1-Y3072 to the sources of the switch devices of the display units 20. Consequently, the pixel electrode 24 is recharged and the gray level of each display unit 20 is changed.

Figure 3:
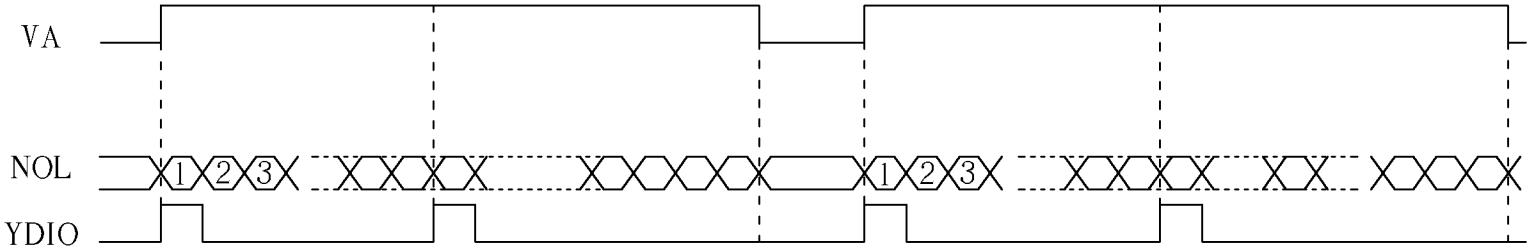
FIG. 3 is a timing diagram showing the signals of gate driver of FIG. 1.

Please refer to FIG. 3. FIG. 3 is a timing diagram showing the signals of the gate driver 14 of FIG. 1. The signal generated by the gate driver 14 includes a perpendicular enable signal VA, a scan line enable signal NOL, and a scan line clock signal YDIO. When the electrical potential of the perpendicular enable signal VA is high, the gate driver 14 will turn the switch device 22 on or off via the scan line 16 whereas when the electrical potential of the perpendicular enable signal VA is low, the gate driver 14 will stop scanning the display unit 20. When the electrical potential of the perpendicular enable signal VA and the scan line clock signal YDIO is high, the gate driver 14 will start scanning each row of the display units 20. By utilizing the scan line enable signal NOL, every row of the display units 20 will be turned on in order, thereby facilitating the conversion of the gray levels of the display units 20. FIG. 3 also shows a waveform of the signal VA, NOL and YDIO of the gate driver 14 during two display periods. As noted in the figure, the voltage level of the scan line clock signal YDIO will switch from a low potential to a high potential twice during each display period. Hence during each display period, the switch devices 22 of one row of display units 20 will be turned on twice, in which the row of the display units 20 will be driven by the source driver 12 and undergo a gray level conversion according to a general image data and a predetermined gray level, which will be further explained below.

Figure 4:
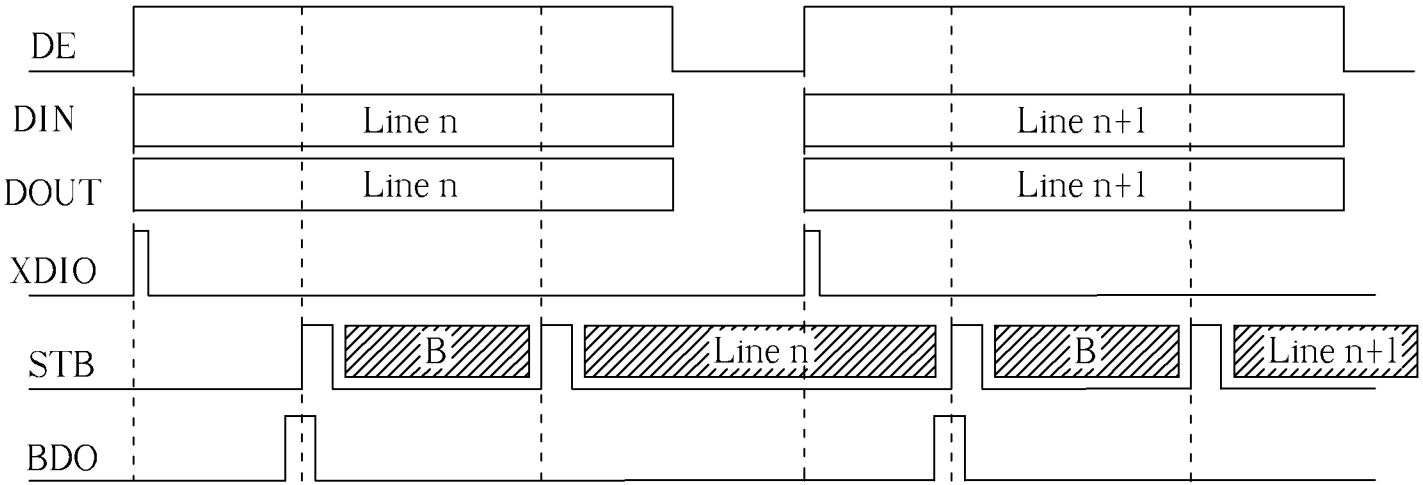
FIG. 4 is a timing diagram showing the related signals of the source driver of FIG. 1.

Please refer to FIG. 4. FIG. 4 is a timing diagram showing the related signals of the source driver of FIG. 1. FIG. 4 also includes a data enable signal DE, original image data DIN and processed image data DOUT. The signal generated by the source driver includes a data line clock signal XDIO, a data line control signal STB, and a data conversion signal BDO. When the electrical potential of the data enable signal DE is high, the original image data DIN will be processed and the processed image data DOUT will be transmitted to the source driver 12 for controlling every step of the gray levels conversion of the display units 20. When the electrical potential of the data line clock signal XDIO is high, the source driver 12 will apply a data voltage to drive the display units 20 scanned by the gate driver 14. When the data line control signal STB is launched and the electrical potential of the data conversion signal BDO is high, the gray level corresponding to the gray level data input to the digital/analog converter is a predetermined gray level, and the voltages of each row of the display units 20 scanned by the gate driver 14 will be equivalent and as a result, the scanned display units 20 will show an identical gray level, which is a predetermined gray level status B. When the data line control signal STB is launched afterward and the electrical potential of the data conversion signal BDO is low, the gray level data input to the digital/analog converter is the processed image signal DOUT described previously, and the display units 20 scanned by the gate driver 14 will show a gray level state Line n or Line n+1 corresponding to the processed image data DOUT.

Figure 5:
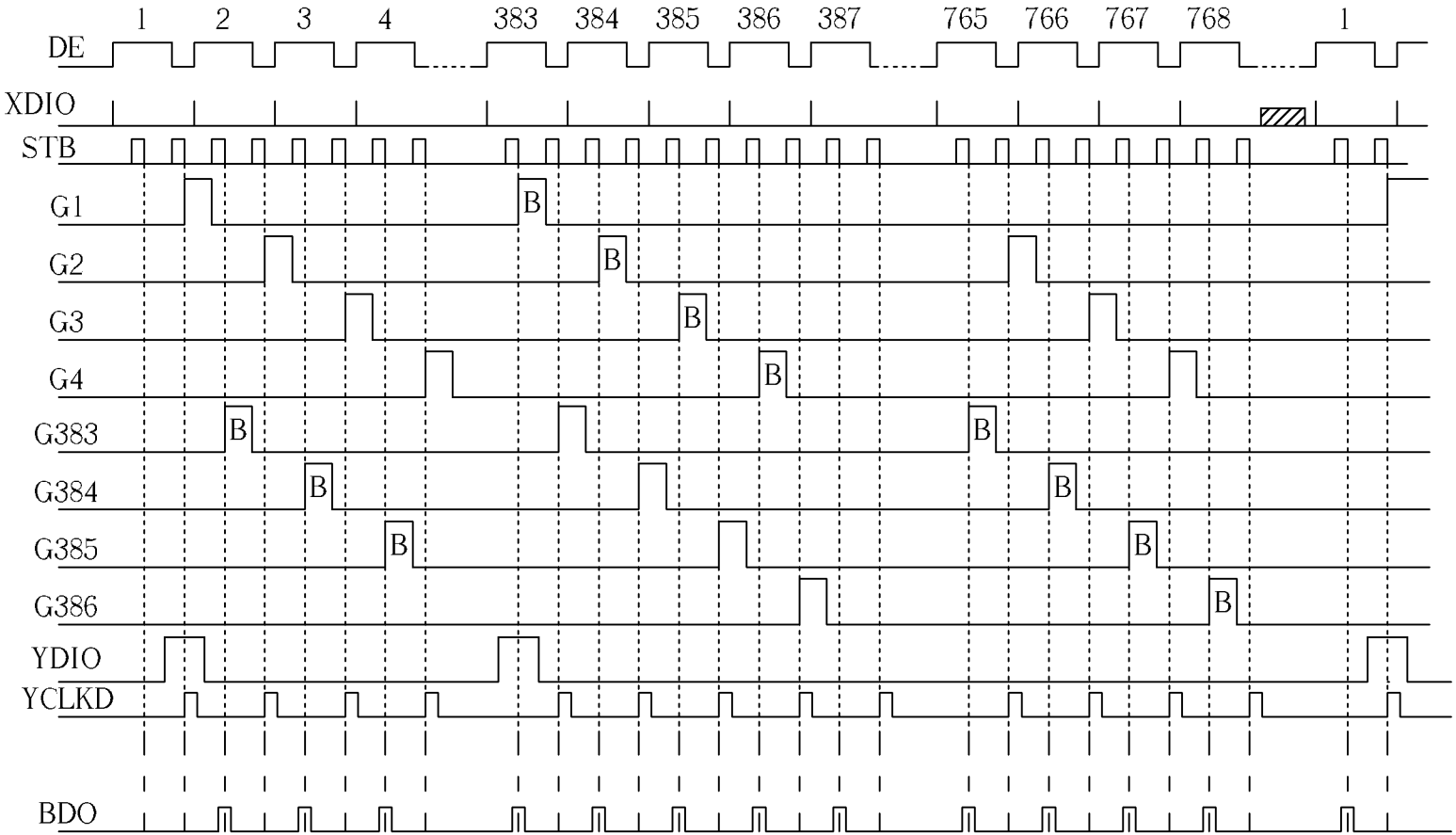
FIG. 5 is a timing diagram showing the related signals of the gate driver and source driver of FIG. 1.

Please refer to FIG. 3 to FIG. 5. FIG. 5 is a timing diagram showing the related signals of the gate driver and source driver of FIG. 1. As shown in the figure, G1-G4 and G383-G386 are gate switch signals generated by the gate driver 14. When the electrical potential of the gate switch signals G1-G4 and G383-G386 is high, the corresponding switch device 22 of the display units 20 will be turned on. For example, when the electrical potential of the gate switch signal G1 is high, the switch device 22 of the first row of the display units 20 will be turned on whereas when the electrical potential of the gate switch signal G385 is high, the switch device 22 of the 385$^{th}$ row of the display units 20 will be turned on. Due to the total lineup of the display units 20 being 768 rows, the number of gate switch signals generated by the gate driver 14 therefore includes G1-G768 (as shown in FIG. 1). For convenience, only the gate switch signals G1-G4 and G383-G386 are shown in the FIG. 5. FIG. 5 essentially shows different waveform transformation of various signals substantially within a display period. Within a display period, each row of the display units 20 is scanned at least twice and FIG. 5 demonstrates an example of each row of the display units 20 being scanned twice.

As shown by the gate switch signal G1-G4 and G383-G386 in FIG. 5, each row of the display units 20 is scanned twice within a display period. When the display units 20 are scanned for the first time, the scanned display units 20 will show a gray level of the original image data as the data switch signal BDO is at a low electrical potential and when the display units 20 are scanned for the second time, the scanned display units 20 will show a predetermined gray level as the data switch signal BDO is at a high electrical potential. In the present invention, the color representation of the stage when the display units 20 are converted to the predetermined gray level stated previously can be black. Therefore, it is evident that the gray level of each row of the display units 20 is converted twice every display period, in which the first conversion is according to the original image data whereas the second conversion is according to the predetermined gray level status. In addition, a perpendicular clock signal YCLKD is also included in the FIG. 5 for latching the scan line clock signal YDIO and generating each of the gate switch signals G1-G768.

Figure 6:
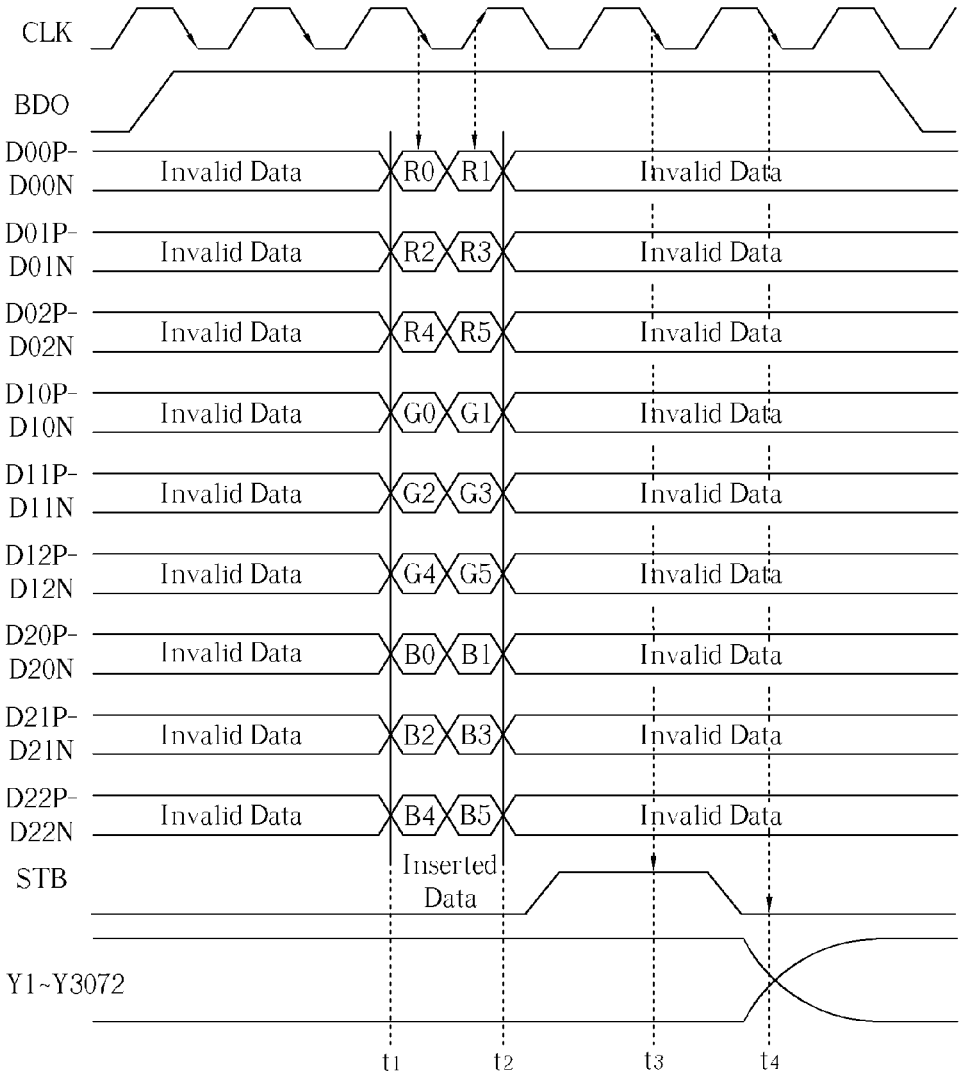
FIG. 6 is a timing diagram showing the related signals of the gray levels of a row of the display units driven by the source driver to a predetermined gray level according to FIG. 1.

Please refer to FIG. 6. FIG. 6 is a timing diagram showing the related signals of the gray levels of a row of the display units driven by the source driver to a predetermined gray level according to FIG. 1. As shown in FIG. 6, the CLK is a periodic clock signal and DOOP-DOON, DO1P-DO1N, DO2P-DO2N, D1OP-D1ON, D11P-D11N, D12P-D12N, D2OP-D2ON, D21P-D21N, D22P-D22N are image differential signals for transmitting digital image signals, in which the image differential signals DOOP-DOON, DO1P-DO1N, and DO2P-DO2N are for transmitting the image data of the red display units 20, the image differential signals D1OP-D1ON, D11P-D11N, and D12P-D12N are for transmitting the image data of the green display units 20, and the image differential signals D2OP-D2ON, D21P-D21N, and D22P-D22N are for transmitting the image data of the blue display units 20. In the present invention, each pixel of the liquid crystal display includes three different color display units 20 of red, blue, and green and the data for determining the gray level of each display unit 20 is six bits. When the electrical potential of the data conversion signal BDO is low, the image data transmitted by the image differential signals DOOP-DOON, DO1P-DO1N, DO2P-DO2N, D1OP-D1ON, D11P-D11N, D12P-D12N, D2OP-D2ON, D21P-D21N, and D22P-D22N are normal image data and for every period of the clock signal CLK, a required data will be transmitted for driving a pixel. Conversely, when the electrical potential of the data conversion signal BDO is high, the image data transmitted by the image differential signals DOOP-DOON, DO1P-DO1N, DO2P-DO2N, D1OP-D1ON, D11P-D11N, D12P-D12N, D2OP-D2ON, D21P-D21N, and D22P-D22N are essentially inserted image data for driving a row of the display units 20 to the predetermined gray level.

When the clock signal CLK is, between $t_1$-$t_2$, switched from a high electrical potential to a low electrical potential for a second time after the data switch signal BDO is switched from a low electrical potential to a high electrical potential, the inserted image data will be received by the source driver 12. Similarly, when the data line control signal STB, between $t_3$-$t_4$, is switched from a high electrical potential to a low electrical potential after the source driver 12 receives the inserted image data, the source driver 12 will apply the same data voltage to a row of display units 20 scanned by the gate driver 14 for driving such row to the predetermined gray level status. In other words, the data line voltages Y1-Y3072 will be substantially the same after $t_4$. In contrast to the fact that the image data corresponding to the pixel is received by the source driver 12 for every other time interval when the electrical potential of the data switch signal BDO is low, the inserted image data utilized by the source driver 12 for driving a plurality of display units 20 is completed within the period of a single clock signal CLK.

In contrast to the prior art, the present invention provides a liquid crystal display and a method for receiving all of the inserted image data of a row of the display units within a certain clock period. Consequently, actions including driving a row of display units and achieving a specific gray level can be completed within a much shorter period of time and with greater efficiency.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for driving a liquid crystal display having a plurality of display units defined into 2M rows and N columns, M and N being positive integers, comprising:

(a) receiving image data of each display unit in a display period;

(b) determining a gray level status of a first row of the display units;

(c) supplying image data to the first row of the display units at a first time period;

(d) supplying predetermined gray level data to an (M+1)-th row of the display units at a second time period, wherein the first time period and the second time period are within the display period and the second time period is consecutively subsequent to the first time period, wherein during the first time period, no image data is supplied to the second row and no predetermined gray level data is supplied to the (M+1)-th row;

(e) supplying predetermined gray level data to the first row of the display units at a third time period; and (f) supplying image data to the (M+1)-th row of the display units at a fourth time period, wherein the third time period and the fourth time period are within the display period and the third time period is subsequent to the second time period and the fourth time period is consecutively subsequent to the third time period.

2. A method for driving a liquid crystal display having a plurality of display units defined into 2M rows and N columns, M and N being positive integers, comprising:

(a) receiving image data of each display unit in a display period;

(b) determining a gray level status of a first row of the display units;

(c) supplying image data to the first row of the display units at a first time period; and (d) supplying predetermined gray level data to an (M+1)-th row of the display units at a second time period, wherein the first time period and the second time period are within the display period and the second time period is consecutively subsequent to the first period;

(e) supplying image data to the second row of the display units at a third time period;

(f) supplying predetermined gray level data to an (M+2)-th row of the display units at a fourth time period, wherein the third time period and the fourth time period are within the display period and the third time period is consecutively subsequent to the second time period and the fourth time period is consecutively subsequent to the third time period;

(g) supplying predetermined gray level data to the first row of the display units at a fifth time period; and (h) supplying image data to the (M+1)-th row of the display units at a sixth time period, wherein the fifth time period and the sixth time period are within the display period and the fifth time period is subsequent to the fourth time period and the sixth time period is consecutively subsequent to the fifth time period.

3. The method of claim 2, wherein the (M+1)-th row of the display units is disposed between the first row of the display units and the (M+2)-th row of the display units.

* * * * *